United States Patent [19]

Rohne

[11] Patent Number: 4,990,053

[45] Date of Patent: Feb. 5, 1991

[54] DEVICE FOR EXTENDING THE PERFORMANCES OF A RADIAL COMPRESSOR

[75] Inventor: Karl-Heinz Rohne, Nussbaumen, Switzerland

[73] Assignee: Asea Brown Boveri Ltd., Baden, Switzerland

[21] Appl. No.: 369,331

[22] Filed: Jun. 21, 1989

[30] Foreign Application Priority Data

Jun. 29, 1988 [CH] Switzerland ..... 2478/88

[51] Int. Cl.[5] ..... F04D 29/44

[52] U.S. Cl. ..... 415/58.4; 415/143; 415/914

[58] Field of Search ..... 415/52.1, 58.3, 58.4, 415/58.6, 914, 182.1, 206, 223, 58.2, 143

[56] References Cited

U.S. PATENT DOCUMENTS

| | | | |
|---|---|---|---|
| 4,212,585 | 7/1980 | Swarden et al. | 415/206 |
| 4,375,937 | 3/1983 | Cooper | 415/58.4 |
| 4,630,993 | 12/1986 | Jensen | 415/914 |
| 4,673,331 | 6/1987 | Kolb | 415/914 |
| 4,743,161 | 5/1988 | Fisher et al. | 415/58.4 |
| 4,781,530 | 11/1988 | Lauterbach | 415/58.6 |
| 4,871,294 | 10/1989 | Ivanov et al. | 415/914 |
| 4,930,978 | 6/1990 | Khanna et al. | 415/58.3 |

FOREIGN PATENT DOCUMENTS

| | | | |
|---|---|---|---|
| 0229519 | 7/1987 | European Pat. Off. . | |
| 2202585 | 9/1988 | United Kingdom | 415/206 |

*Primary Examiner*—John T. Kwon

*Attorney, Agent, or Firm*—Burns, Doane, Swecker & Mathis

[57] ABSTRACT

In a radial compressor the device for extending the performance at small throughputs by stabilizing the impeller flow in the inlet region comprises a recess (5) in the form of a groove which is oriented in the circumferential direction of the inlet duct (6) of the compressor, whereas in the flow direction it extends with a given axial width to the impeller (2). A stabilization ring (3) is integrated into said recess (5), being arranged in front of the impeller (2) and outside the principal flow (7) of the transported medium. A plurality of blades (4,4*a*), which are placed on the outer circumference of the stabilization ring (3), are in turn anchored to the inner contour of the recess (5).

15 Claims, 3 Drawing Sheets

DEVICE FOR EXTENDING THE PERFORMANCES OF A RADIAL COMPRESSOR

The present invention relates to a device for extending the performance of a radial compressor according to the precharacterizing clause of claim 1.

BACKGROUND OF THE INVENTION

1. Field of the Invention

In the use of turbocompressors, whether they be radial or axial, it is attempted for the sake of high reliability during partial load operation to achieve stable characteristics falling monotonously with increasing throughput without hysteresis. However, stable characteristics are the more difficult to achieve under partial load, the higher the pressure ratio at the design point becomes. Attempts are made to remedy this in practice; to achieve the desired characteristics by additional stabilization devices. Due to differences in the design of the blades and in the structures of the regions of change from laminar to turbulent flow during partial load operation, no clear technical solution has hitherto crystallized out, according to which a general handy stabilization device could be derived.

It is therefore impossible to say at present with scientific precision whether a stable characteristic can be achieved at all, and with what stabilization device, in a given compressor. This unsatisfactory situation is experienced particularly in the case of radial compressors.

2. Discussion of Background

A stabilization device in a radial compressor, which has become known from EP-A No. 1-0,229,519, possesses the feature that the inner housing, as the jacket of the impeller, exhibits radial or quasi radial bores. Said bores establish a connection between approach flow duct and blading, being masked more or less on the blade side by the blades. Although such bores shift the pumping limit and stability limit in the characteristic, they do so at the cost of high losses of efficiency which may amount to 4–5 per cent. It is substantially impossible by this proposed solution to achieve the desired extension of performance at small throughputs which would be necessary due to the instabilities which occur for a specific mode of operation. Another significant factor here is that this minimal stabilization effect has to be obtained at the cost of a disproportionately high loss of efficiency.

SUMMARY OF THE INVENTION

Accordingly, one object of this invention is to provide a novel device in radial compressors for extending the performance at small throughputs by stabilization of the impeller flow in the inlet region with predeterminable precision.

The essential advantage of the invention lies in the fact that this device behaves neutrally as long as the radial compressor is transporting the full volume flow; only when different flow structures appear, particularly under partial load, does the device come into operation and make it impossible for foreground detachment phenomena to appear across the entire partial load range. The feared "pumping" is also inhibited, which produces stable characteristics. A further advantage of the invention lies in the fact that the device represents a simple structural measure which can be provided in every radial compressor, irrespectively of its technical specification. Advantageous and convenient further developments of the solution of the object according to the invention are described in the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
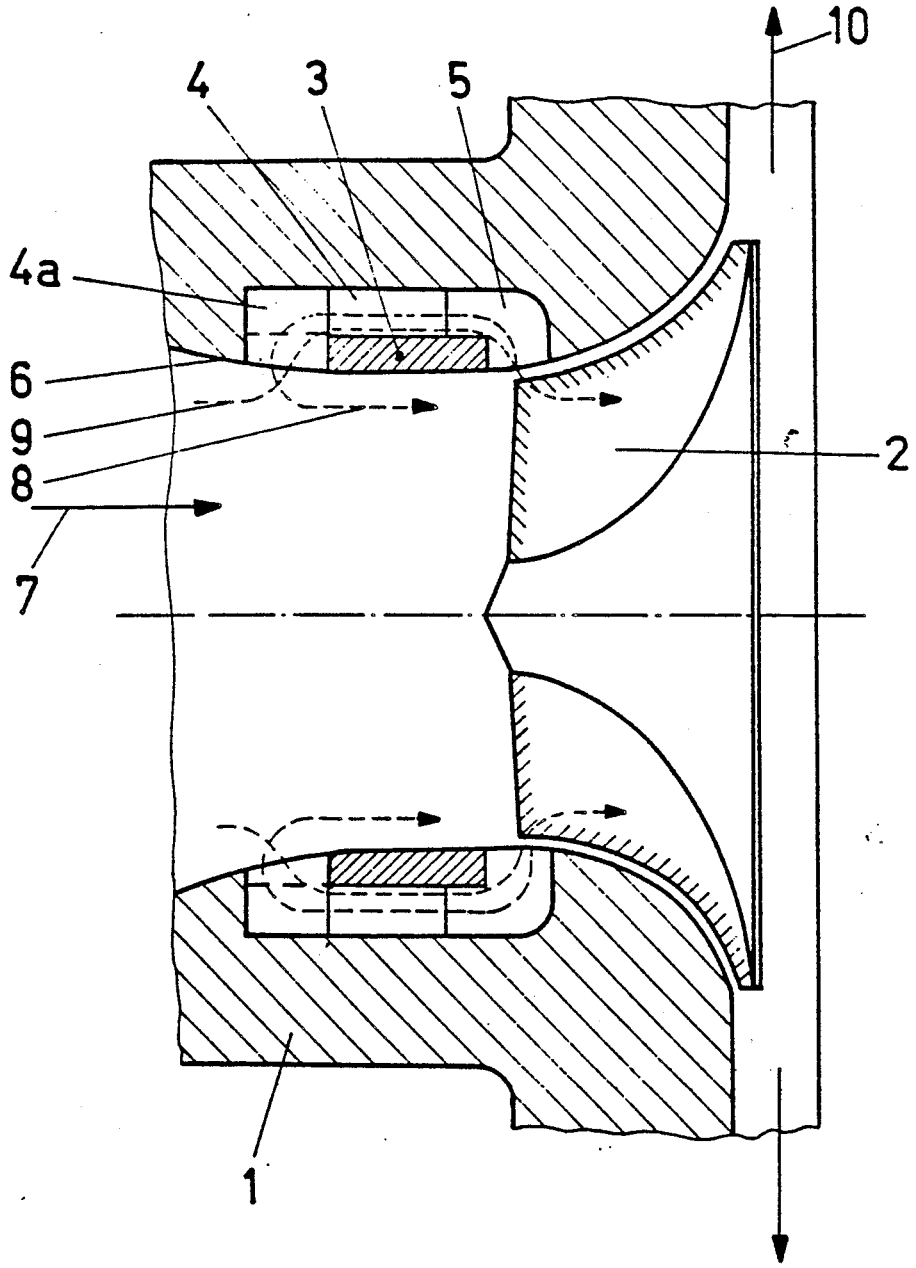
FIG. 1 shows a radial compressor with a device which permits the performance of the compressor to be extended.

Referring now to the drawings, wherein like reference numerals designate identical or corresponding parts throughout the several views, in FIG. 1 is shown a partial elevation of a radial compressor in the region of a device provided for extending the performance during operation of such a compressor. The device generally produces a stabilization of the impeller flow in the inlet region during partial load operation. The radial compressor comprises housing 1 and impeller 2, the above-mentioned stabilization device being provided in front of the impeller 2 and itself consisting of a stabilizer aperture 5, a stabilization ring 3 and a number of stabilizer blades 4. The stabilizer aperture 5 has the form of an internal groove and extends into the housing 1 for a given depth in the radial direction, starting from the surface of the inlet duct 6; in the axial direction it extends approximately from the approach flow edge of the impeller 2 for a given length upstream. The stabilization ring 3 is integrated into the stabilizer aperture 5, its inner circumferential surface extending in the prolongation of the surface of the inlet duct 6. The outer circumference of the stabilization ring 3 is fitted with a number of blades which fill the remaining inside width of the stabilizer aperture 5 in radial extension and are anchored there. The wall thickness of the stabilization ring 3 is a function of the strength and stability required operationally. From aerodynamic considerations, the wall thickness of the stabilization ring 3 must not prejudice unnecessarily the height of the stabilizer blades 4. This is therefore a bladed stabilizer variant which ensures a better effect towards eliminating a hysteresis or instability range compared to an unbladed construction. Although an unbladed construction of the stabilizer per se also causes a reduction of an instability region, nevertheless an elimination of the latter cannot be achieved with it. This is largely connected with the fact that the volume flow circulating in the partial load states, relative to the volume flow transported by the compressor, is greater for a bladed stabilizer than for an unbladed one. These differences originate from the different loss coefficients of the stabilizers. In principle, the correct design of the stabilizer lies predominantly in the correct choice of the outside diameter of the stabilization ring 3, which must be coordinated with the compressor, that is to say with the outside diameter at the impeller inlet, in each case so that on the one hand only a little flows through the stabilizer aperture 5 at the best point, so that the efficiency does not fall, whilst on the other hand as great as possible a flow 8 must circulate under partial load. Naturally, after the choice of the outside diameter of the stabilization ring 3 has been fixed, an interdependence exists between the latter and the dimensions of the other elements of the device.

Figure 3:
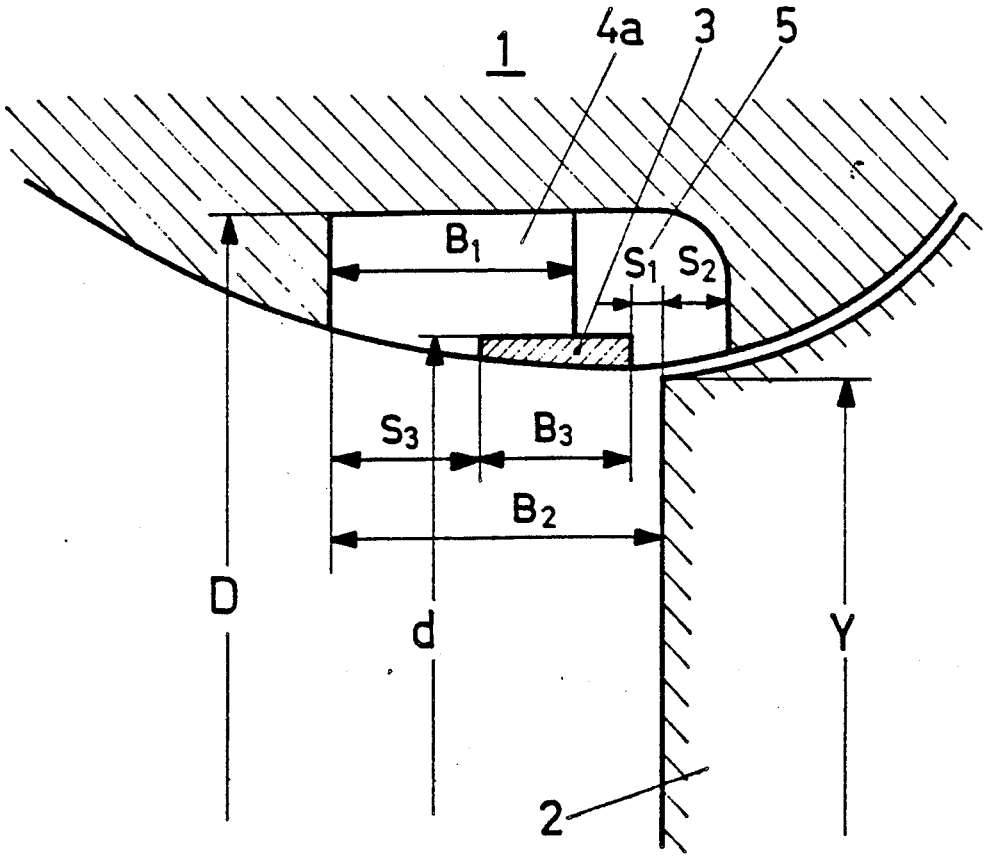

We refer in this context to the explanation of FIG. 3. Under overload, part of the delivery flow 9 flows through the stabilizer aperture 5 in the same flow direction as the principal flow 7, with which it strikes the impeller 2 and is then discharged as compressed air to the passage 10. In the stabilizer aperture 5 the partial delivery flow 9 also acquires a countertwist, due to which the efficiency assumes a tendency to increase. As may also be seen from FIG. 1, the example of construction mentioned here is designed so that the impeller 2 projects into the stabilizer aperture 5. The reason for this is, that the further the impeller 2 projects into the stabilizer aperture 5, the more work is transmitted to the circulating air, the greater is the circulating volume flow 8, and the greater is the stabilizing effect of the device. The width of the stabilizer blade 4 in the flow direction of the recirculating partial load flow 8 is variable, as indicated by the dash-line stabilizer blade 4*a*, and can assume the entire residual width of the stabilizer aperture 5 in this extension plane. A stabilizer blade 4*a* of the greatest possible width has a channeling effect upon the partial flows 8,9 and helps to increase the stability of the device under partial load and overload.

Figure 2:
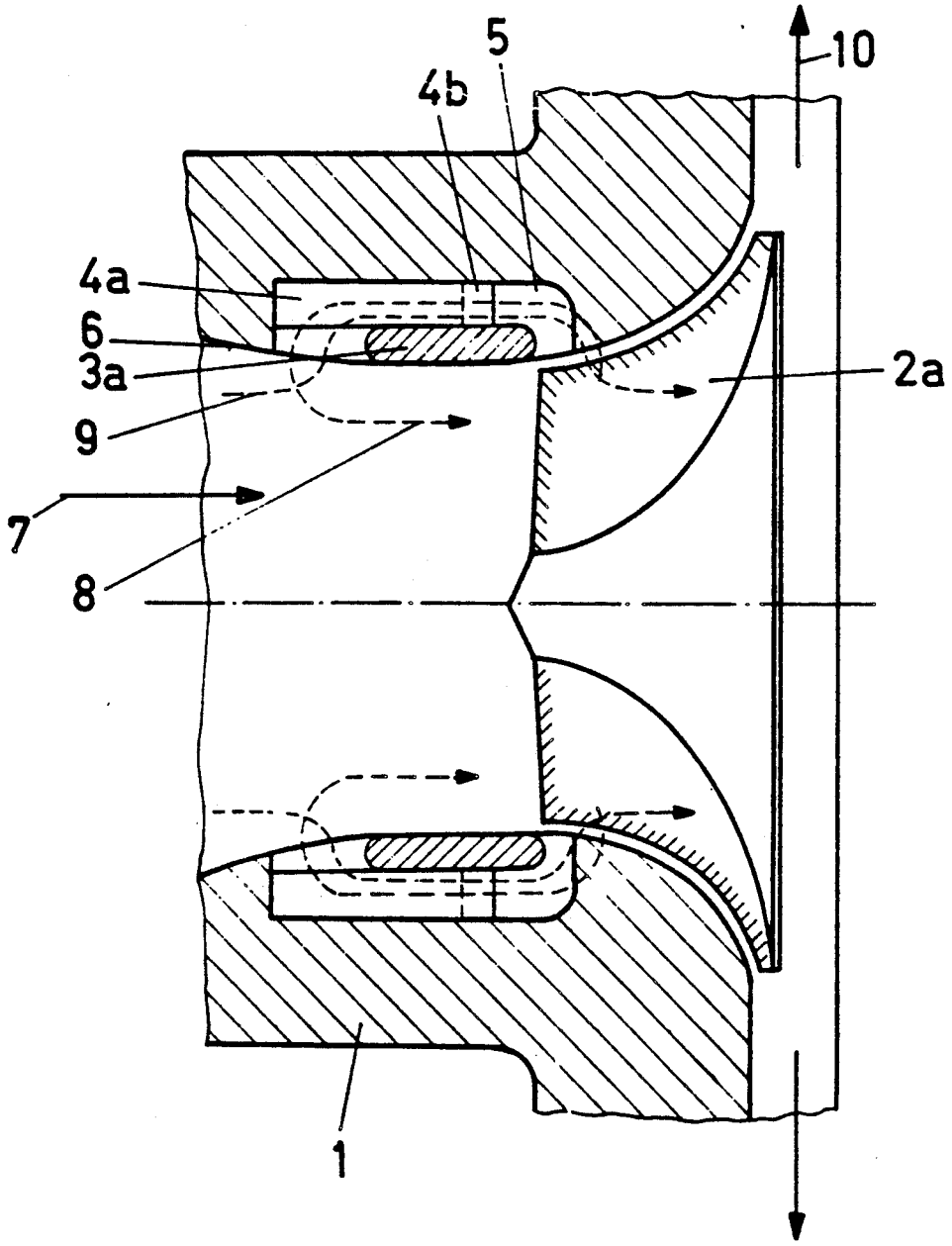
FIG. 2 shows a radial compressor with a structural extension of the device and FIG. 3 shows a dimensional definition of the device.

FIG. 2 likewise shows a radial compressor according to FIG. 1 with a further development of stabilization ring 3 and stabilizer blade 4*a* for the purpose of obtaining an improvement in the flow in the stabilizer aperture 5 under partial load. The stabilization ring 3*a* has a profiled construction, whereas the stabilizer blade 4*a*, which exhibits the maximum axial extension in the flow direction of the partial load flow 8, is developed further by an approach flow aid 4*b*. These measures permit an improvement, although small, in the characteristics under partial load. FIG. 2 also shows an example of the increase postulated under FIG. 1 in the stabilizing effect of the device by extending the impeller 2*a* a long way into the stabilizer aperture 5 in the counterflow direction. As FIG. 2 shows, it is immediately feasible structurally to make the impeller 2*a* project into the stabilizer aperture 5 as far as the stabilization ring 3*a*.

FIG. 3 forms the basis of the next explanation. As stated in the description under FIG. 1, the correct design of the stabilizer consists primarily in the correct choice of the outside diameter d of the stabilization ring 3. It is obvious that this diameter d must stand in a definite ratio to the outside diameter of the impeller inlet aperture Y if it is sought to ensure the advantages in view from the operation of a radial compressor with a device for stabilizing the impeller flow in the inlet region, particularly under partial load. A correct choice of the outside diameter of the stabilization ring d consists in limiting it to the range 1.02–1.05 to the outside diameter of the impeller input aperture Y. The dimensions of the other elements of the device are derived from this initial choice, and for the sake of clarity the dimensions of these elements are afterwards expressed as a numerical ratio to the respective outside diameter of the impeller inlet aperture Y.

The following relations may be summarized:

The overlap dimension S2 of the impeller 2 relative to the stabilizer aperture 5 is in the ratio 0–0.06 to the outside diameter of the impeller inlet aperture Y.

The residual aperture S3 between initial edge of the stabilizer aperture 5 and initial edge of the stabilization ring 3 in the flow direction to the impeller 2 is in the ratio 0.06–0.12 to the outside diameter of the impeller inlet aperture Y.

The width B1 of the stabilizer blades 4*a*, calculated from the inlet edge of the stabilizer aperture 5 in the flow direction, is in the ratio 0.08–0.22 to the outside diameter of the impeller inlet aperture Y.

The outside diameter D of the stabilizer aperture 5 is in the ratio 1.08–1.21 to the outside diameter of the impeller inlet aperture Y.

The active width B2 of the stabilizer aperture 5, which results from the total width of the stabilizer aperture 5 less overlap dimension S2, is in the ratio 0.12–0.26 to the outside diameter of the impeller inlet aperture Y.

The effective width B3 of the stabilization ring 3 is in the ratio 0.06–0.16 to the outside diameter of the impeller inlet aperture Y.

The gap aperture S1 between end edge of the stabilization ring 3 and inlet edge of the impeller 2 is in the ratio 0–0.04 to the outside diameter of the impeller inlet aperture Y.

Finally, the outside diameter d of the stabilization ring 3 is—as already explained—in the ratio 1.02–1.05 to the outside diameter of the impeller inlet aperture Y.

The extremely close ranges of these ratios clearly demonstrate that the design of a new optimized device for extending the performance under partial loads in a radial compressor can be decided without preliminary laboratory experiments.

Obviously, numerous modifications and variations of the present invention are possible in the light of the above teachings. It is therefore to be understood that, within the scope of the appended claims, the invention may be practiced otherwise than as specifically described herein.

What is claimed as new and desired to be secured by Letters Patent of the United States is:

1. A compressor arrangement extending the performance of a radial compressor at small throughputs in the inlet region of a radial flow impeller of a radial compressor comprising a recess which is oriented in the circumferential direction of an inlet duct of the radial compressor and which extends upstream from an inlet aperture of the radial flow impeller, a stabilization ring being integrated in said recess and arranged in front of the radial flow impeller and outside the principal flow of the transported medium, an inlet edge of said radial flow impeller being located downstream of an end edge of the stabilization ring and upstream of an end edge of said recess, said stabilization ring carrying on its outside circumference a number of blades which are themselves anchored to an inner contour of the recess.

2. The device as claimed in claim 1, wherein the radial flow impeller overlaps the end edge of the recess to form an overlap dimension, said overlap dimension being in the radio 0–0.06 to an outside diameter of the inlet aperture of the impeller.

3. The device as claimed in claim 1, wherein a gap aperture between said end edge of the stabilization ring in the flow direction and said inlet edge of the radial flow impeller is in the ratio 0–0.04 to an outside diameter of the inlet aperture of the radial flow impeller.

4. The device as claimed in claim 1, wherein an outside diameter of the stabilization ring is in the ratio 1.02–1.05 to an outside diameter of the inlet aperture of the radial flow impeller.

5. The device as claimed in claim 1, wherein a width of the stabilization ring is in the ratio 0.06–0.16 to an outside diameter of the inlet aperture of the radial flow impeller.

6. The device as claimed in claim 1, wherein an aperture of the recess which extends from an inlet edge of the recess in a flow direction to the radial flow impeller is in the ratio 0.12–0.26 to the outside diameter of the inlet aperture of the radial flow impeller.

7. The device as claimed in claim 1, wherein a width of the stabilizer blades, calculated from an inlet edge of the recess in the flow direction, is in the ratio 0.08–0.22 to an outside diameter of the inlet aperture of the radial flow impeller.

8. The device as claimed in claim 1, wherein an outside diameter of the recess is in the ratio 1.08–1.21 to an outside diameter of the inlet aperture of the radial flow impeller.

9. A compressor arrangement extending the performance of a radial compressor at small throughputs in the inlet region of an impeller of the compressor comprising a recess which is oriented in the circumferential direction of an inlet duct of the radial compressor and which extends upstream from an inlet aperture of the impeller, a stabilization ring being integrated in said recess and arranged in front of the impeller and outside the principal flow of the transported medium, said impeller positioned to overlap an edge of the recess farthest in the flow direction to form an overlap dimension, said overlap dimension being in the ratio 0–0.06 to an outside diameter of the inlet aperture of the impeller, said stabilization ring carrying on its outside circumference a number of blades which are themselves anchored to an inner contour of the recess.

10. The device as claimed in claim 9, wherein a gap aperture between an end edge of the stabilization ring in the flow direction and an inlet edge of the impeller is in the ratio 0–0.04 to said outside diameter of the inlet aperture of the impeller.

11. The device as claimed in claim 9, wherein an outside diameter of the stabilization ring is in the ratio 1.02–1.05 to the outside diameter of the inlet aperture of the impeller.

12. The device as claimed in claim 9, wherein a width of the stabilization ring is in the ratio 0.06–0.16 to the outside diameter of the inlet aperture of the impeller.

13. The device as claimed in claim 9, wherein an aperture of the recess which extends from an inlet edge of the recess in a flow direction to the impeller is in the ratio 0.12–0.26 to the outside diameter of the inlet aperture of the impeller.

14. The device as claimed in claim 9, wherein a width of the stabilizer blades, calculated from an inlet edge of the recess in the flow direction, is in the ratio 0.08–0.22 to the outside diameter of the inlet aperture of the impeller.

15. The device as claimed in claim 9, wherein an outside diameter of the recess is in the ratio 1.08–1.21 to the outside diameter of the inlet aperture of the impeller.

* * * * *